United States Patent [19]

Klose

[11] 4,324,402

[45] Apr. 13, 1982

[54] ELECTRONIC BASEBALL GAME

[75] Inventor: George J. Klose, Redondo Beach, Calif.

[73] Assignee: Mattel, Inc., Hawthorne, Calif.

[21] Appl. No.: 1,231

[22] Filed: Jan. 5, 1979

[51] Int. Cl.[3] ..... A63F 9/00

[52] U.S. Cl. ..... 273/88; 273/85 G

[58] Field of Search ..... 273/1 E, 85 G, 88, 93 R, 273/94, 138 A, 237, 1 GC, 1 G, 1 GE; 364/410, 717; 235/92 GA

[56] References Cited

U.S. PATENT DOCUMENTS

| | | | |
|---|---|---|---|
| 3,337,218 | 8/1967 | Hurley | 273/85 G |
| 3,778,058 | 12/1973 | Rausch | 273/85 G |
| 3,790,170 | 2/1974 | Alexander | 273/88 |
| 3,874,669 | 4/1975 | Ariano et al. | 273/85 G |
| 4,093,223 | 6/1978 | Wilke et al. | 273/94 R |
| 4,095,791 | 6/1978 | Smith et al. | 273/DIG. 28 |
| 4,162,792 | 7/1979 | Chang et al. | 273/85 G |
| 4,195,838 | 4/1980 | Santandrea | 273/85 G |
| 4,249,735 | 2/1981 | Bromley | 273/85 G |

FOREIGN PATENT DOCUMENTS 2807231 8/1978 Fed. Rep. of Germany ... 273/85 G

OTHER PUBLICATIONS

*JS&A Catalog*; "Computer Stadium Baseball;" available as of Nov. 27, 1978; p. 42.

*101 Basic Computer Games*; Mar. 1975; pp. 26–28.

*Primary Examiner*—Vance Y. Hum

*Attorney, Agent, or Firm*—John G. Mesaros; Max Shirk; Ronald Goldman

[57] ABSTRACT

A hand held electronic game for baseball or the like having a playing field with illuminatable segments thereon at positions generally corresponding to potential player positions. One group of segments defines the path of a player object such as a ball which when "impacted" in response to a correctly timed manual input illuminates one of another group of segments. The "player" is advanced in response to another manual input a distance determined by the segment so illuminated. Game control and game status is under control of a processor using probabilities to determine game events. In the embodiment illustrated, the game is in the form of a baseball game with the segment depicted on a baseball diamond.

23 Claims, 4 Drawing Figures

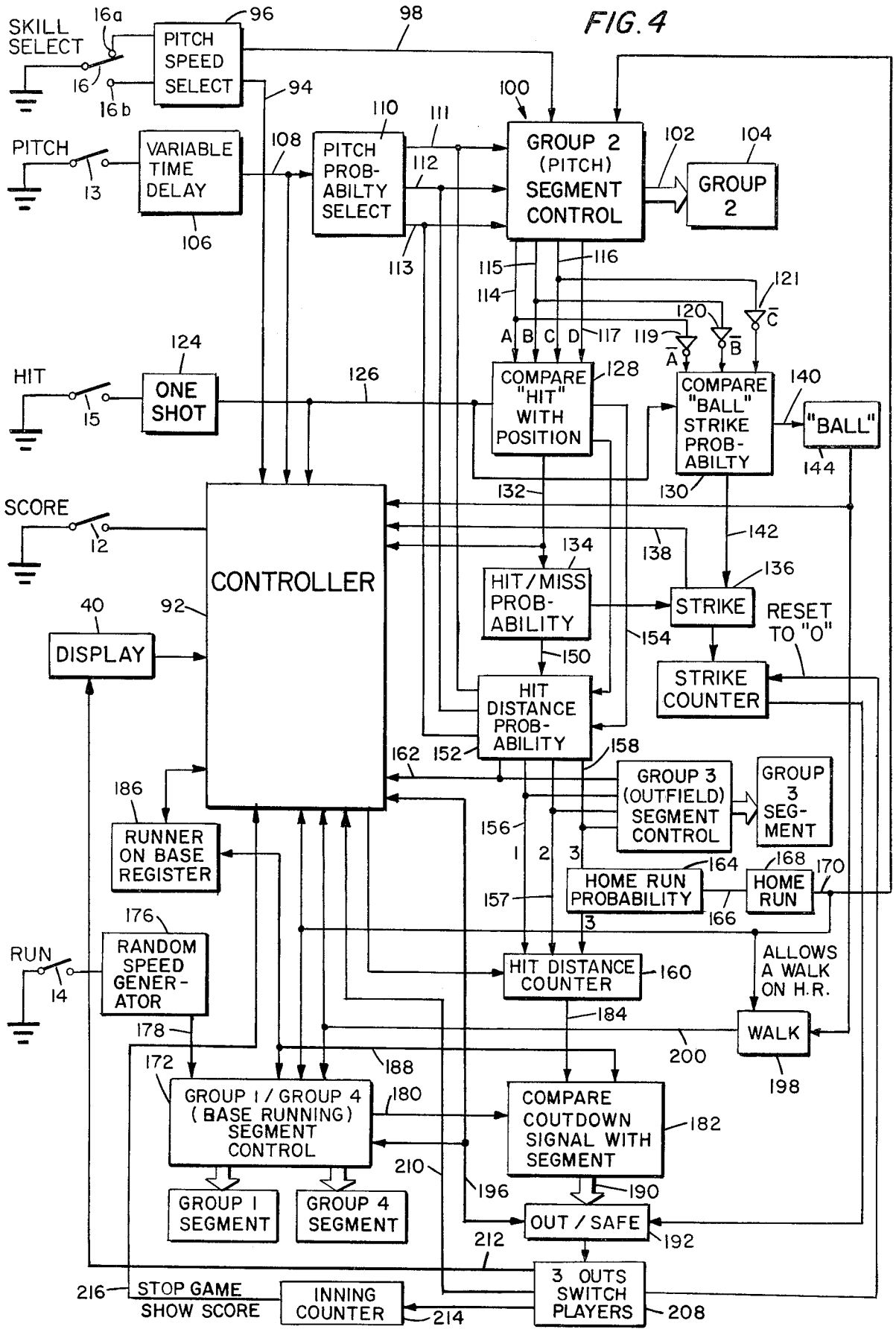
FIG. 4
SKILL SELECT
16a
16
16b
PITCH SPEED SELECT
96
98
94
PITCH
13
VARIABLE TIME DELAY
106
108
PITCH PROB-ABILTY SELECT
110
111
112
113
100
GROUP 2 (PITCH) SEGMENT CONTROL
102
104
GROUP 2
115
116
114
121
120
117
119
A B C D
HIT
15
ONE SHOT
124
126
COMPARE "HIT" WITH POSITION
128
COMPARE "BALL" STRIKE PROB-ABILTY
140
"BALL"
144
130
132
SCORE
12
CONTROLLER
92
138
142
134
HIT/MISS PROB-ABILITY
136
STRIKE
RESET TO "0"
40
DISPLAY
154
150
STRIKE COUNTER
HIT DISTANCE PROB-ABILITY
162
152
158
GROUP 3 (OUTFIELD) SEGMENT CONTROL
GROUP 3 SEG-MENT
186
RUNNER ON BASE REGISTER
156
1 2 3
164
168
170
HOME RUN PROBABILITY
HOME RUN
157
166
176
RANDOM SPEED GENER-ATOR
RUN
14
HIT DISTANCE COUNTER
160
ALLOWS A WALK ON H.R.
184
178
WALK
200
198
172
188
GROUP 1 / GROUP 4 (BASE RUNNING) SEGMENT CONTROL
180
COMPARE COUTDOWN SIGNAL WITH SEGMENT
182
210
196
190
GROUP 1 SEGMENT
GROUP 4 SEGMENT
OUT / SAFE
192
212
216
STOP GAME SHOW SCORE
INNING COUNTER
214
3 OUTS SWITCH PLAYERS
208

ELECTRONIC BASEBALL GAME

BACKGROUND OF THE INVENTION

The background of the invention will be discussed in two parts:

FIELD OF THE INVENTION

This invention relates to electronic games and more particularly to a hand held electronic game for simulating baseball or the like.

DESCRIPTION OF THE PRIOR ART

Numerous electronic games have been developed in the past several years, and with the rapid development of miniaturized components, such as micro-processors, in the past two years many products have come to market in the form of compact electronic games. The number of variables which can be handled by microprocessors, and the numerous control functions possible, have enabled such hand held games to simulate for example football, war games, and baseball.

In games such as baseball, cricket and the like, a playing field is defined with playing positions established for the team on the playing field. A ball is delivered by a player on the field with a member of the opposing team positioned in a fixed location relative to the path of travel of the ball, the object being to hit the ball with a bat or the like. In the conventional baseball game, the "batter" may cause any one of the following events to occur: no swing resulting in a ball or a strike; a swing resulting in a hit or a miss; a hit resulting in a caught fly ball; a hit, not caught, out of play; or a hit resulting in one, two, three or four bases. The game events occurring on the playing field are further modified if another member of the "team at bat" is on base during any of these events. Consequently, although the game playing field is fairly well defined, the number of given events which can occur under given conditions results in a large number of variables to be considered in a simulated game context.

Accordingly, it is an object of the present invention to provide a new and improved electronic game.

It is another object of the present invention to provide a new and improved hand held electronic game for simulating baseball or the like.

It is a further object of the present invention to provide a new and improved electronic game having a processor utilizing probability determining means for controlling game displayed events.

SUMMARY OF THE INVENTION

The foregoing and other objects of the invention are accomplished by providing an electronic game having a housing for receiving electronic components therein with a viewable display field having a plurality of illuminatable segments thereon, a first group of segments at positions defining base positions, a second group of segments simulating the path of a thrown ball, a third group of segments simulating outfield positions, and a fourth group of segments at positions generally intermediate the base positions. Manually operable input means are provided by momentary contact buttons for "pitching", "hitting", and "running". The electronic means include processor control of segment illumination in response to probability determining means for controlling game events upon receipt of the manual inputs, the processor control being in accordance with predetermined algorithms establishing probability and game sequencing events. The processor continually monitors game status and updates game status as events occur with the game status being displayed on alphanumeric display means. The probability determining means and processor control, for example, (1) the selection, sequential illumination, and speed of sequencing of illumination of the second group of segments to simulate a "curve ball", a "fast ball", or a "slow ball" in response to manual depression of the "pitch" button; (2) the selection of a "hit" or a "strike" in response to the timing of the depression of the "hit" input when compared with the illumination of a predetermined segment of the second group of segments; (3) the selection of the probability of a "strike" or "ball" in the event that the "hit" input is not depressed prior to the last segment being illuminated in the series of the second group of segments; (4) the selection of the probability of the "hit" distance, as a function of time in response to a "hit" indication; (5) the selection of the probability of the "hit" ball being caught or not, and if not, a translation of the "hit" distance into a probable number of bases reachable by the "player"; (6) the selection of "run" speed of the "player" and the sequential illumination of segments of the first and fourth group after receipt of an input in response to manual depression of the "run" button. Means are provided for comparing the status of the time function indicating "hit" distance with the position of the runner indicated by the particular segment of the first and fourth group of segments illuminated to determine whether the runner is "safe" or "out". Other means are provided for controlling a segment simulating a man on base in response to "hit" events. The processor continually monitors and updates events occurring per player and total game status events with the status being periodically displayed on alphanumeric displays. Audible means are provided to indicate certain game events such as a "home run," the number of bases correlating to a particular hit, outs and the like.

Other objects, features and advantages of the invention will become apparent from a reading of the specification when taken in conjunction with the drawings in which like reference numerals refer to like elements in the several views.

BRIEF DESCRIPTION OF THE DRAWINGS

FIG. 4 is a functional block diagram of the system of FIG. 3.

DESCRIPTION OF THE PREFERRED EMBODIMENT

Figure 1:
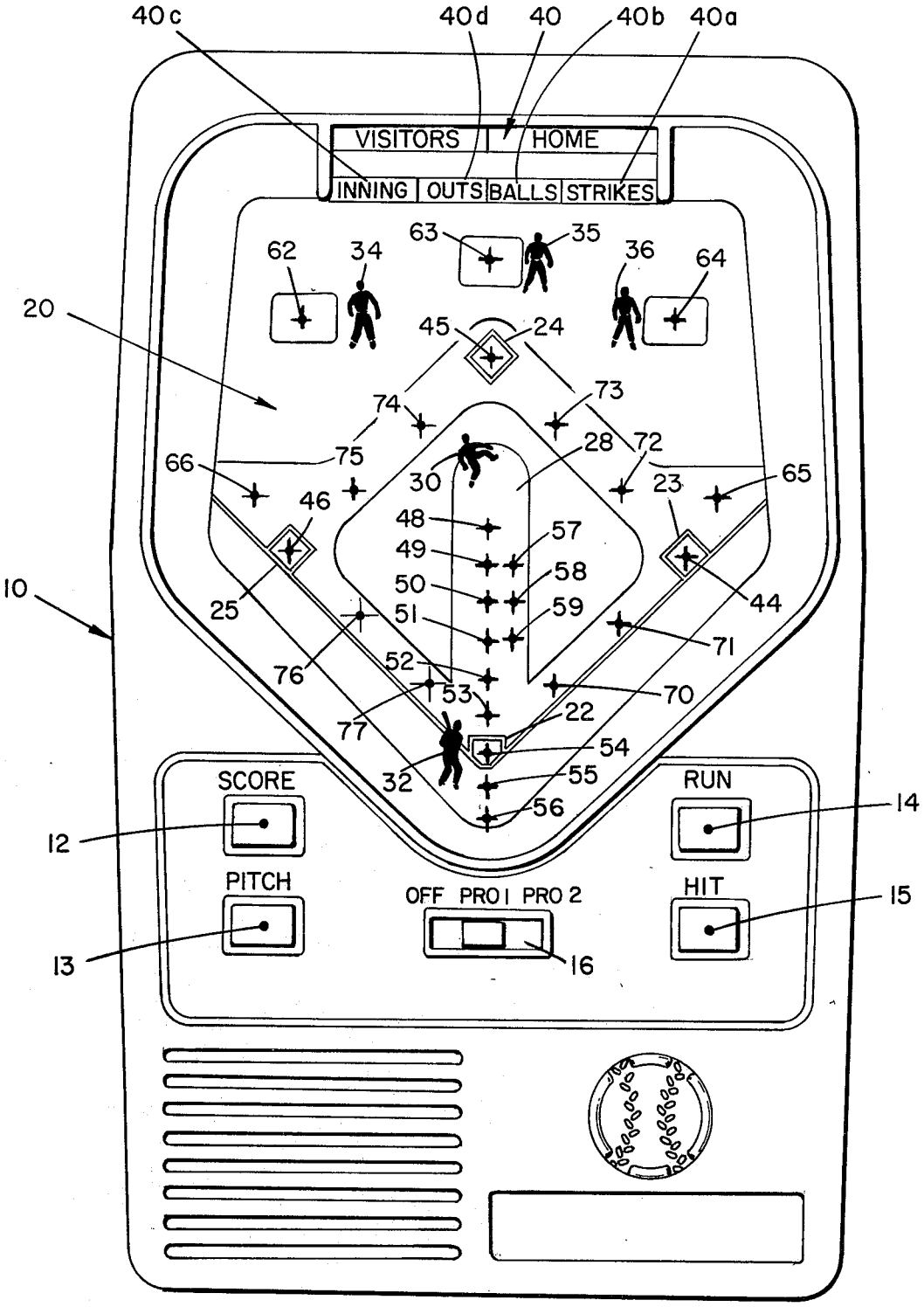
FIG. 1 is a plan view of the electronic game according to the invention.

Referring now to the drawings and particularly to FIG. 1 there is shown a hand held electronic game having a housing 10 having a plurality of switches 12–15 mounted thereon, the switches 12–15 being momentary on push button switches for providing manually controlled input for operation of the game. The switches are symmetrically arranged with a fifth switch 16 being provided generally centrally relative to the lower switches 13 and 15. The switch 16 is a three-position slide switch which can be actuated from a left "off" position to the center "Pro 1" position or to the right to a "Pro 2" position. In the center position, the switch 16 sets the electronic system to a normal skill level, while positioning the switch 16 to the right provides an advanced skill level by speeding up certain actions.

Each of the switches 12–15 is provided with an appropriate designation for indicating an operator-controlled input for controlling certain of the game events or for providing an indication of game status. Switch 12 is provided with an indication of "score", switch 13 is provided with an indication of "pitch", switch 14 is provided with an indication of "run", and switch 15 is provided with an indication of "hit".

The main portion of the front surface of the housing 10 is provided with a simulated playing field generally designated 20 which is a plastic plate member which may be transparent or translucent, but in any event must be at least partially light transmitting. Imprinted upon the surface or superimposed thereon by means of a separate plastic film, is a playing field which, in the instant embodiment, depicts a baseball diamond having a home plate 22 and first, second and third base positions 23–25, with the positions 22–25 defining a player run path from home plate 22 sequentially to first, second and third bases 23–25, the player thence returning to the home plate position 22. The layout of the base positions 22–25 is intended to simulate the actual relative position of the bases on a playing field in baseball. Similarly, a pitcher's mound 28 is provided along the line between home plate position 22 and second base position 24, with the pitcher's mound 28 being positioned closer to second base position 24 relative to a line drawn between first and third base positions 23 and 25. A pitcher characterization 30 and a batter characterization 32 may be suitably imprinted on the playing field 20 at the pitcher's mound 28 and home plate position 22 respectively.

The upper portion of the playing surface 20, referred to as an "outfield" on a baseball diamond, has suitably inscribed thereon characterizations 34–36 of other game players representing the outfield positions of the team occupying the field. Above these outfield positions, the housing 10 is configured for receiving an alphanumeric display generally designated 40 for providing a visual indication of the status of the game during play, the visual indication providing a display of game status as a particular player 32 is at bat, providing a display of game status for each period or "inning" and for providing a display of total game progress, that is, the number of periods played as well as the score.

It is to be understood, however, that although the description proceeds with reference to the American baseball game, the game and the system is equally applicable to other games such as cricket in which the playing field 20 is configured to define a player object path such as a ball and a player advance path such as the base path to be run with certain specified other player positions being defined, the game object being to "hit" the ball and advance along the advance path after doing so.

Figure 2:
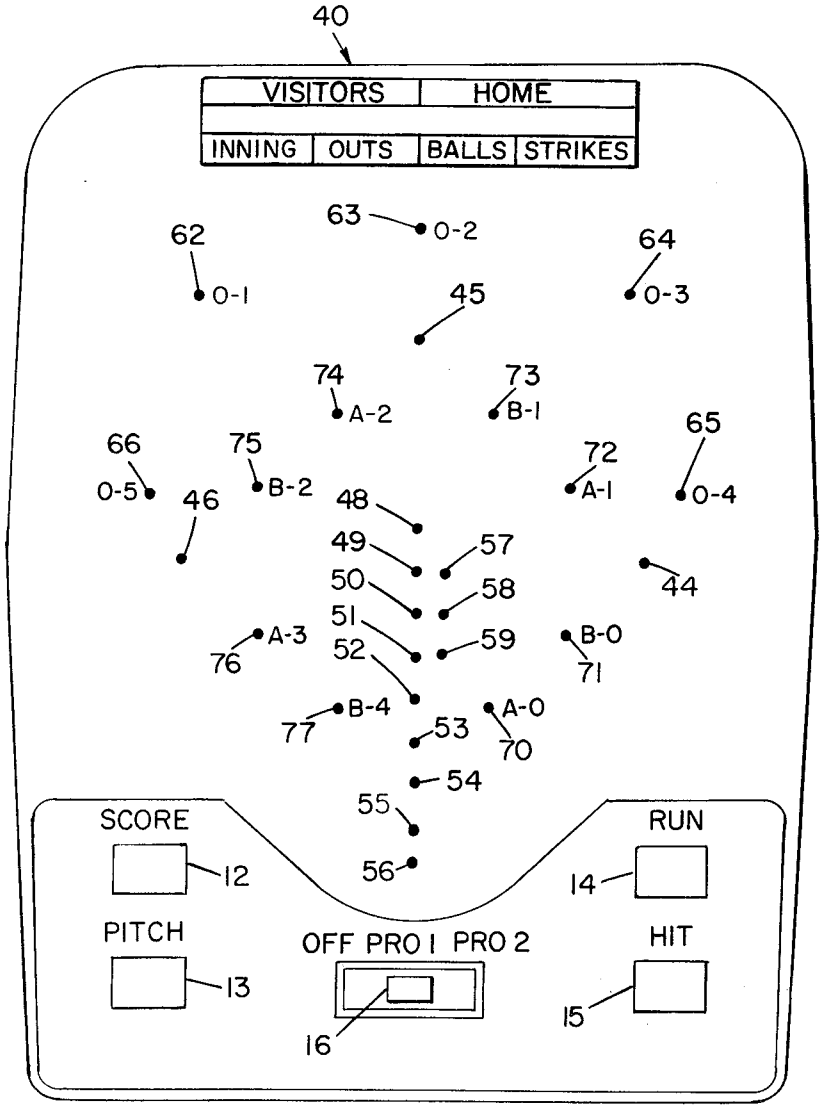
FIG. 2 is a plan layout view of the play field board illustrating illuminatable segments of the playing field of the game of FIG. 1 with the manually controlled switches and the game status display thereon.

The playing surface 20 in FIG. 1 has illustrated thereon a plurality of cruciform designations which are not ordinarily viewable through the playing surface 20, these cruciform positions depicting the location of a plurality of illuminatable segments, such as light emitting diodes for example, with each of the segments being in a predetermined location and illuminatable in response to a combination of manually entered conditions and machine controlled conditions for displaying activity on the playing surface 20. These segments are also illustrated in FIG. 2 wherein the segments and switches are assembled on a printed circuit board 42 which is assembled within the housing 10 immediately below the plastic plate member forming a part of the playing surface 20. Each of the cruciform designations in FIG. 1 correlates to one of the bold dots in FIG. 2 and the reference character for a particular segment on FIG. 1 will be the same reference character for the same segment on FIG. 2. In addition, for purposes of explanation hereinafter, certain of the segments in FIG. 2, in addition to a reference numeral will likewise carry an additional designation of a letter and number.

Referring to FIGS. 1 and 2, the segments, for the purpose of explanation, are divided into functional groupings, the first group of segments 44, 45 and 46 being directly under and centrally disposed relative to the "base" locations 44–46 respectively. A second group of segments 48–59 inclusive are selectively illuminated for simulating the path of a pitch in a baseball game from the pitcher's mound 28 to home plate position 22. A third group of segments 62–65 are provided at positions in the outfield, and when illuminated, depict locations to which a ball may be hit with segments 62, 63 and 64 being positioned adjacent the outfield characterizations 34, 35 and 36 respectively.

A fourth group of segments 70–77 inclusive are positioned, in pairs, in aligned relation with and intermediate the segments immediately beneath the home plate position 22 and the base positions 23–25. These segments 70–77 in conjunction with segments 44, 45, 46, and 54 define a generally rectangular configuration or "diamond" which in turn, defines the player running path with the segments being sequentially illuminated at a randomly selected rate within a predetermined range to indicate a player advancing along the base path. By way of example, if a "hit" is effected the run button 14 is depressed with the sequence of illumination being from segment 54 sequentially through segments 70, 71, 44, 72, 73, to 45 (assuming a two base hit). Similarly, the player running path segments between base locations will be sequentially illuminated if a player is on base and a subsequent player receives a "hit".

In FIG. 2, each of the segments of the fourth group are also provided with a supplemental reference designation utilizing a capital letter followed by a number with the designations being an "A" or a "B" to designate respectively, nearness to a preceding or following base location, the illumination of these segments by certain signals within the game affecting the result in accordance with a timed function occurring during player piece advance as will hereinafter be described.

Similarly, the segment locations outwardly and upwardly of the "diamond" have adjacent thereto a supplemental reference designation consisting of an "O" followed by a numeral to designate five outfield segments, the signal illuminating a particular segment, and the type of illumination, being determined by algorithms within the processor of the system examining variables such as the time relation between depression of the hit button 15 relative to the signal illuminating a particular segment of the second group of segments with a probability determination of a hit, which if effected, is followed by a probability determination of a travel distance as a function of time which in turn illuminates one of the outfield segments 62–66 to a flickering state or a steady state indicating a "hit" of a number of bases or an "out" respectively.

Briefly, the play of the game is as follows. The unit is turned on by actuation of the slide switch 16 to the center or right hand position thereby selecting a skill level. The game is intended for two players, one of whom is the "home" team and the other of whom is the "visitor" team. The players then select their turns with the normal period in a baseball game being an inning which is completed after three outs. The pitch button 13 is depressed to initiate the start of the game. Once the pitch button 13 is depressed, after a time delay, the system sequentially illuminates certain segments of the second group to define the path of a pitched ball from the pitcher's mound 28 to the home plate position 22. The particular segments to be illuminated within this group and the speed of sequencing of illumination is determined by the processor to provide either the simulation of a curved ball or the simulation of a fast pitch or the simulation of a slow pitch. The sequence of illuminations for either a fast or slow pitch would be from segments 48 through 56, these segments defining a straight line with the rate of sequential illumination stimulating a fast or slow ball. As can be seen in FIGS. 1 and 2, segments 57, 58 and 59 are adjacent to segments 49, 50 and 51 respectively. If the processor determines a "curve" ball the sequence of illumination would be segment 48, segment 57, segment 58, segment 59, and segments 52–56. The segments within the group are further subdivided with segments 53–55 being defined as the "strike zone," this subgroup within the group having significance relative to the timing of the depression of the hit button 15 relative to the signal illuminating a predetermined one of this subgroup of segments, and also has significance depending upon the lack of actuation of the hit switch 15 in a timely manner.

As in conventional baseball, depending upon the swinging or not swinging by the batter certain conditions may exist. The batter may not swing in which event a strike or a ball may be called upon him. The batter may swing in which event he may or may not hit the ball, a strike being called in the event of the latter situation. The batter may hit the ball and may or may not get on base, and in the event the batter does get on base, he may advance one, two, three, or four bases, that is, a home run.

These conditions are simulated in the game according to the instant invention by the time relation between the signal inputted as a result of depression of the hit switch 15 relative to the signal illuminating a particular segment within the pitch path as modified by probability determining means within the system. For example, if the signal from the hit switch 15 occurs prior to or at the same time as the illumination of segment 52 (outside the subgroup) a strike will be registered and displayed on the segment 40*a* of display 40. If no signal is inputted, or if the signal is inputted from the hit switch 15 subsequent to the signal illuminating the last segment 56 to be energized in the series of segments, the system probability determining means computes the probability of a strike versus the probability of a ball which is then displayed on display segments 40*a* and 40*b* of display 40 to indicate the number of balls and number of strikes. The ball or strike is called at random at a ratio of three strikes to two balls thus enhancing the play of the game. When the hit switch 15 is depressed prior to the illumination of segment 53, after the illumination of segment 56 or not at all, segment 56, representing the ball, remains illuminated for approximately two seconds after which time the illumination is cancelled and the system awaits the next input from the pitch switch 13.

If the hit switch 15 is depressed when the ball position is indicated at segments 53, 54 and 55, probability determining means within the system determine the chance of success of "impact" of the "bat" with the "ball". The particular segment illuminated in timed correlation with the input signal from the hit switch 15 results in the particular segment 53, 54, or 55 remaining illuminated for an extra length of time indicating the swing within the strike zone. The computer or processor then determines that there is a 20% probability that the batter missed and therefore a stike is called and then displayed on display segment 40*a*. Alternatively, the processor may determine that the batter has connected with a 50% constant probability that it is a fly ball which will be caught or a 50% probability that the batter has connected, in which event, the processor includes a matrix in memory alloting a given "travel distance" which is correlated to a time function depending on the type of pitch (that is curve, fast or slow pitch) and the segment illuminated (or stopped) as determined by the timing of the input signal from the hit switch 15. Effectively, the matrix or table will determine one, two, or three bases as a probability that the runner can advance, the hit indication initializing a timed counter which, when timed out, causes the processor to examine conditions existing to determine runner segment illuminated relative to the timed out event for determining whether or not the runner is safe.

For a given hit, one of the outfield segments 62–66 is illuminated for a predetermined time period, the selection of the particular segment being illuminated depending upon the processor selection of the probable number of bases. Similarly, if the processor selects a caught fly ball one of the outfield segments 62–66 will be illuminated but will flash at a perceivable rate of 4–8 flashes per second. If the processor selects the probability of a one base hit, much as in the manner of a conventional baseball game, if the swing is early and the batter connects, this would be indicated by the stopping or illuminating of the segment 53 upon occurrence of the "hit" which would drive the ball to left field, this movement of the ball not being observed on the display until the "ball" position is indicated by illumination of one of the outfield segments. For a left field single, the segment 66 (0-5) will be illuminated, and correspondingly if the hit is late thus indicating illumination of segment 55 the single will be to the right field, that is the illumination of segment 65 (0-4). Correspondingly, segment 62 (0-1) and 64 (0-3) will signify a double to left or right field respectively depending upon the illumination of segments 53 and 55 respectively. A triple or three base hit will be signified by the illumination of segment 63 (0-2). To provide a more ready indication of the number of bases, the system is provided with an audible tone equal to the probable number of bases which can be reached.

Further subdivided within the probabilities of a successful hit is the probability of the hit being a "home run" as opposed to a one or more base hit with a 1/5th probability being applied in the event a three base run is indicated. The three base run, that is the illumination of segment 63 (0-2) will occur when the timing of the input signal from the hit switch 15 corresponds or occurs within the dwell time of the signal illuminating the central segment 54 within the "strike zone" of segments 53–55. At this point, if the computer determines that a home run probability has occurred, selected ones of the fourth and second groups of segments will be sequentially activated to provide a special visual effect with segments 70 and 71 as a pair being illuminated followed in succession by the pair of segments 72 and 73, followed by the pair of segments 74 and 75, and thence followed by the pair of segments 76 and 77 followed by groupings of illuminations of segments 49–51 as a group, and then in succession segments 57–59 as a group, the total effect being to simulate the base running with special effects.

In the event of either a hit (with bases indicated by illumination of one of the outfield segments) or a walk, the advancement of the runner is effected by depression of the run switch 14. If a "walk" is indicated, depression of the run switch 14 will sequentially illuminate segments 70, 71 and 44 with a corresponding sequential illumination of other segments from base to base if a base is previously occupied by a runner which would be signified by the particular base being illuminated during play. If a base hit is indicated, upon depression of run switch 14, a signal is inputted to the processor whereupon a random runner speed is selected to control the rate of sequential actuation of the segments in the base running path.

As previously indicated, for a given base hit, such as a three base hit, the counter is set to count down a predetermined number indicative of a travel distance for the base hit. For example, a three base hit may indicate a ball distance of 230 to 300 feet with a nominal distance of 265 feet with the counter being set according to the random selection of a number of feet within the range of 230 to 300 feet. Upon depression of the hit switch 15 the counter commences counting down to the predetermined time interval. After depression of the run switch 14 and with the rate of sequential illumination of the base path segments being visually observed by the operator, the operator must make a determination whether or not three bases can be achieved within the time allowed as determined by the runner speed ascertained. The signals illuminating the base path signals are compared with the timer count signal effected after total countdown, and if the runner is on a base at the moment of countdown the runner is "safe". This would be visually displayed by the constant illumination of the particular base segment at this time. For example, if the runner's speed is observed to be "slow" and the three base segment 63 (0-2) is illuminated the operator may desire to stop the runner at second base 24 depicted by segment 45 rather than elect the chance of being caught off base. If the runner's speed is intermediate the operator may elect to maintain the run switch 14 in its depressed condition thereby attempting to reach third base. If either segments 74 or 75 is illuminated at the time the countdown signal is effected, the runner will be "out", this effect being visually displayed by the flashing of the particular segments 74 or 75 for a predetermined time. Alternatively, if the sequencing of the base path segments are rapid, thereby indicating a fast runner speed, the probability of success of the operator reaching the base indicated by the outfield segment displayed is high. This random runner speed selection only occurs if one of the outfield segments 62–66 (0-1 to 0-5) is illuminated for a predetermined length of time. If a home run is indicated, runner speed is not a factor.

The fourth group of segments, that is segments 70–77 have additional significance in the event that, during the play of a game period, a player is occupying one of the base positions 23–25 as indicated by the illumination of one of the segments 44, 45 or 46 respectively. If a walk is determined by the processor, any runner on base will be advanced one base upon depression of the run switch 14, and if the man on base is indicated by the illumination of the third base segment 46, this runner will advance as simulated by sequential illumination of segments 76, 77 and 54 with an appropriate sound being generated to indicate a run scoring with the processor memory being updated to indicate the additional run which may be visibly displayed upon depression of the score switch 12. The runner receiving the walk will then be advanced to first base as simulated by the sequential illumination, at the same time, of segments 70, 71 and 44.

If a runner is on base when a hit is effected, the play of the game is altered by the processor as follows. If the segment illustrating the batter position did not pass first base 23, he is out and the other runner(s) return to the base position last occupied. If the batter passed first base 23, when the countdown zero signal is received, the leading runner is out and the remaining runners move back to the preceding base location if the remaining runner is on one of the segments designated "A" or moves forward to the next succeeding base location if the runner is on one of the segments designated "B" if, at the moment of the counter countdown signal, the runners are on base locations, that is on one of the segments within the first group, all runners are safe.

With respect to each game period, the progress of play is monitored and upon the occurrence of three outs, the other player then takes his turn. The display 40 is time divided and provided with upper and lower indicia of the information displayed. For example, displays **40*a* and 40*b* during an "at bat" display strikes and balls respectively. Similarly, display sections 40*c* and 40*d* display the inning and the number of outs for that inning. Upon the depression of the score switch 12, the display then displays the score with the home team score being displayed in display sections 40*c* and 40*d* and the visitors team score being displayed in display sections 40*a* and 40*b***.

Figure 3:
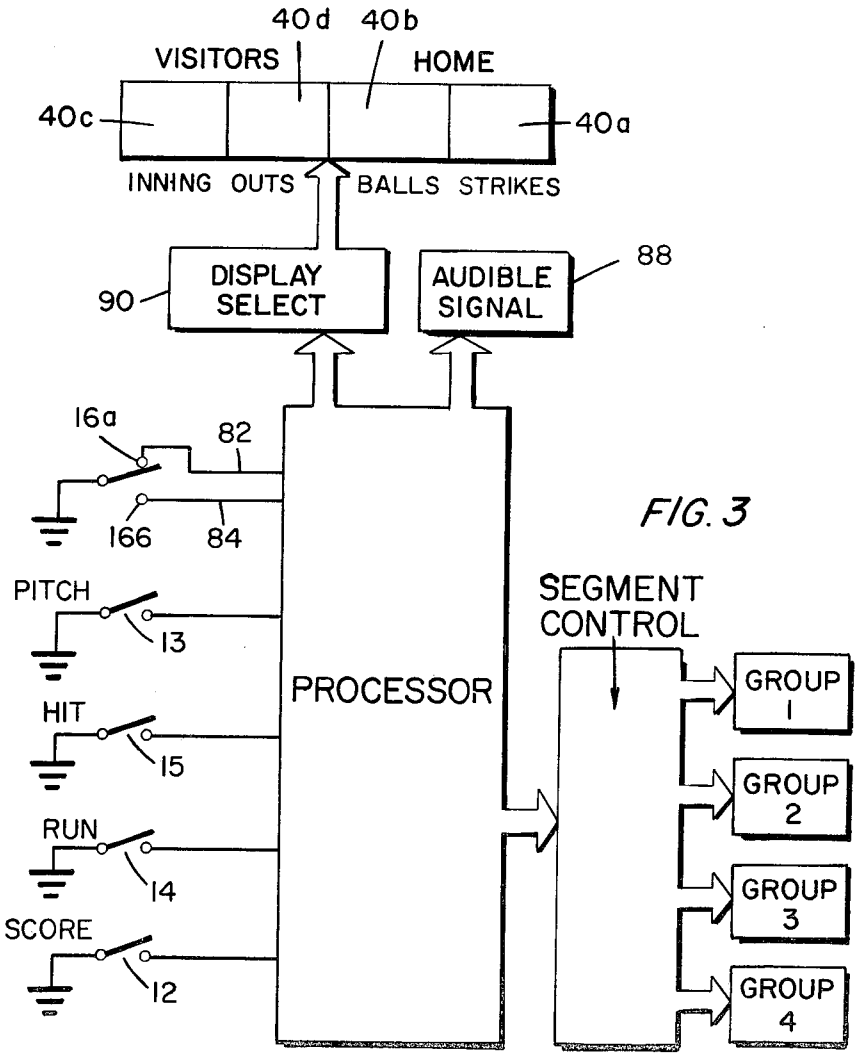
FIG. 3 is a general block diagram of the electronic system utilized in the game of FIG. 1.

Referring now to FIG. 3, there is shown a general system block diagram including a micro-processor generally designated 80 which receives the inputs from the momentary contact switches 12–15 to affect the play of the game in accordance with the algorithms within the micro-processor 80. Switch 16, which is a slide switch is operable from the off position (not shown) to a first position **16*a* or to a second position 16*b* for providing a signal over leads 82 or 84 respectively for affecting the speed of sequencing of the segments of group 2, that is the segments depicting or simulating the path and speed of a thrown ball. In the higher skill level position, the rate of sequencing of the segments of group 2, is increased by 25%–30% over the rate of sequencing with the switch 16 in the normal skill level position. The processor 80 includes probability determining means, random number generating means within a range with the appropriate predetermined algorithms necessary to affect the progress of play in accordance with the manual input provided by actuation of the input switches 13, 14 and 15 to correspondingly permit the transmission of data from processor 80 to a segment select subsystem 86 to selectively and sequentially energize the illuminatable segments of group 1, group 2, group 3 and group 4 in accordance with events and conditions occurring during play of the game. Similarly, under processor 80** control, an audible signal generating means 88 is provided for generating audible signals or sounds in response to occurrence of certain game events such as base hit, home run, end of inning, end of game and the like. The game status is likewise visually displayed by means of the display segments 40a–40d which operate through a display select subsystem 90. Normal game play events such as balls and strike, innings and outs are displayed at appropriate time with depression of the score switch 12 altering the display select subsystem 90 to display the score accumulated within the processor 80. Although the display select subsystem 90 and segment select subsystem 86 are shown external to processor 80, these functions are performed within the processor 80.

Referring now to FIG. 4, there is shown a functional block diagram of the system according to the invention with functional portions of the processor 80 of FIG. 3 broken out in functional form. Certain buffers and the like have been omitted for the purpose of clarity and similarly the audible signal generating means 88 has been eliminated as well as details of the display 40. The switches are provided with the same reference numerals for ease of description. A control portion 92 of the processor 80 receives information for maintaining and updating the status of the play of the game during the progress thereof for controlling information to the display 40.

When the game is originally started and the switch 16 moved to the 16a or 16b position, the game is initialized by transmission of a signal over lead 94 to the controller 92, thereby setting all counters and registers as well as resetting the display 40. The pitch speed select 96 also transmits a signal over lead 98 to a group 1 segment controller 100, the group 1 segments simulating the path of travel of a pitched ball. The controller transmits the information over bus 102 to the group 1 segment shown as a grouping in block 104. With the game set, a pitch is initiated by depression of switch 13, this signal being transmitted to a variable time delay means 106 which, after a delay of 1.5 to 2.5 seconds initiates a signal over lead 108 to both the controller 92 and a pitch probability select means 110. The select means 110 then energize one of three leads 111, 112 or 113 to designate to the group 1 segment controller 100 a curve ball, a fast ball, or a slow ball respectively for enabling the sequential energization and the rate of energization of the segments of group 1. The output of the segment controller is monitored over leads 114–117, a signal appearing on these leads designated "A–D" corresponding respectively to signals illuminating the segments within the home plate 22 region, that is segments 53, 54, 55 and 56 respectively. The outputs appearing on leads 114–116 are also inverted to provide "not A" through "not C" outputs through inverters 119–121 inclusive. If a "hit" signal is generated by depression of hit switch 15, a one shot multi-vibrator 124 transmits a signal over lead 126 to processor 92 as well as to first and second comparators 128 and 130 which, respectively receive, the signals indicative of energization of the segments within the strike zone and the inverted signals. In the event the signal over lead 126 is received when any signal appears on leads 114–117, information is transmitted over lead 132 to both the controller 92 and a hit/miss probability selector 134. If a miss is indicated a signal is outputted to a "strike" indicator 136, the information from which is transmitted over lead 138 to the controller 92 for updating the game events.

Alternatively, if the information received from lead 126 is compared in comparator 130, and none of the inputs are high, the comparator 130 determines the probability of a ball or strike which information is transmitted respectively over leads 140 or 142 to the ball indicator 144 or the strike indicator 136 respectively. Similarly, the ball indicator signal 144 is transmitted to the controller 92. The absence of a signal on leads 114–116 at the time of generation of the hit signal indicates that the switch 15 was depressed before the illumination of segment 53 or after the illumination of the last segment 56 in the series of segments of the pitching path.

With respect to the "D" signal, that is the signal energizing segment 56, each of the segments is energized for a predetermined time and if the hit signal is received in comparator 130 after segment 56 has been illuminated for 0.5 seconds or more, it is considered to be a late swing in which event a ball or strike signal is generated at random with a ratio of three strikes to two balls. If the hit signal is received during the first 0.5 seconds of illumination of segment 56, it is automatically a strike thus outputting a signal over lead 142 to so indicate.

In the event the hit/miss probability generator 134 determines a hit, an output is transmitted over lead 150 to a hit distance probability means 152. The hit distance probability is selected from a "table" which is essentially a matrix algorithm which examines both the type of pitch received from output leads 111–113 of a pitch probability selector 110 as well as the location at which the ball was hit from information received over bus 154 from the comparator 128. The bus 154 provides the information regarding the occurrence of receipt of the hit signal over lead 126 in time relation to the signal providing the energization of segments 53, 54 and 55, these segments generally corresponding to the strike zone in which a base hit is possible. A signal is then outputted over either of leads 156–158 to indicate a one, two or three base hit, with the particular selection being determined in accordance with the following table:

| Pitch Type | Ball A | "Hit" B | At C |
|---|---|---|---|
| Fast | 2 | 3 | 1 |
| Curve | 1 | 2 | 1 |
| Slow | 1 | 2 | 1 |

From the above table, the designations A, B and C indicate signals for illuminating the segments 53, 54 and 55 respectively with the designations "1", "2", and "3" depicting the number of bases alloted. Furthermore, the hit distance probability means 152 also computes a "travel distance" for the ball within a given range of 70 feet to 300 feet, these distances being then translated to time functions when received by the hit distance counter 160. Within the range, for example, a one base hit will represent 70 to 140 feet of travel with any distance therebetween being selected for the counter 160. Likewise, a two base hit will select a random distance within the range of 150 to 220 feet, and correspondingly three bases will translate into 230 to 300 feet any of the "distances" outputted by way of signals over leads 156–158 will correspondingly be transferred into a time function by means of a counter 160 which then counts down to zero to signify the end of travel of the ball as a function of time. The hit distance probability generator 152 may also generate a fourth output over lead 162 to indicate an out situation, that is, notwithstanding the fact that a distance has been selected a particular one of the outfield segments 62–66 will be illuminated but instead of remaining on for a predetermined time duration, the particular signal will flash indicating the out. Correspondingly, the information within the controller 92 will be updated to reflect this occurrence.

Although the output on lead 158 normally indicates a three base hit, the signal is also utilized as an input to a home run probability means 164 that one time out of 5 a home run will occur, this signal being passed over lead 166 to the home run signal block 168, the output of which is transmitted over lead 170 to the controller 92 as well as to the segment controllers 100 (for group 2 segments) and 172 (for groups 1 and 4 segment illumination). In the 4 out of 5 cases, the three run base hit will set the hit distance counter 160.

Once the player observes that a hit has been indicated by illumination of one of the outfield segments 62–66, this indication also being provided audibly by means of the audible signal generator 88 which sound one, two or three times, the player then depresses the run switch 14 which provides an output from a random speed generator 176 over lead 178 to the group 1/group 4 segment controller 172. The random speed generator 176 selects a running speed which is normal, fast or slow with the output being transmitted over lead 178 to control the rate of energization of sequencing of the base path segments, that is, the segments of group 1 and group 4 to simulate the base running previously described. A signal indicative of the particular segment energized is transmitted over lead 180 to a comparator 182 which compares the output on lead 180 with the count down output over lead 184 along with runner on base information received from a register 186 under control of the controller 92 (should any other runners be on base), the output of register 186 being transmitted over lead 188 to provide an input to the comparator 182. This data is then transmitted over data bus 190 to an out/safe indicator 192. The information from the out/safe indicator 192 is then transmitted over lead 196 to the controller 92 as well as the group 1/group 4 segment controller 172. The illumination of the base path segment is altered as described previously in accordance with a predetermined algorithm which examines information relating to players on base, that is, the contents of the register 186 which indicates if a runner is on one or more of the three bases 23–25. The movement of these runners is altered upon actuation of the run switch 14 in response to a hit condition or a "walk" condition symbolized by actuation of the walk signal 198 which monitors the ball signals 144, the output being fed over lead 200 to the group 1/group 4 segment controller 172 as well as the controller 92. A "walk" signal 198 occurs with one of two events, these being "four balls" or a "home run" from indicator 168. In either event the countdown is immobilized and depression of run switch 14 may be depressed at any time to advance the runners. The algorithm affecting the base path running also includes provisions for determining the occurrence of illumination of the group 4 segment at the end of countdown of the countdown signal compared in comparator 182 for determining advancement or withdrawal of a runner on the base path determined by the position of the runner relative to a base after a hit.

The "out/safe" indicator 192 output is continually provided to a "switch players" monitor or counter 208 which provides an output over lead 210 to the controller 92 as well as over lead 212 to the display 40. The controller 92 appropriately updates the information with display 40 visually indicating the condition. With each six outs (three outs per side), a signal is transmitted from monitor 208 to an inning counter, which provides an output signal over lead 216 to the controller 92 after a predetermined number of innings to terminate the game play and display the final score.

In accordance with the system hereinabove shown and described, many of the variables of game events occurring during the typical baseball game are simulated with selection of machine control perimeters being generated randomly, in accordance with certain probabilities, or within certain ranges established as functions of time, with machine operation being compared against a manual input operator controlled for automatically affecting the progress of the game in play in accordance with the timing and skill of the operator. Although the above description has proceeded with reference to a baseball game, it is to be understood that the game according to the present invention is equally applicable to games such as cricket or the like in which a machine controlled object, such as a ball, is generated for traversing a given path, a player's piece is controlled by first and second manual input means, the first manual input discerning time relation occurrence between the object and the manual input for establishing a game perimeter correlated as a function of time. Depression of the second manual input affects player piece movement along a defined path against the clock, that is, against the time function established for the game perimeter with predetermined algorithms within the system automatically affecting the progress of the game in play and automatically maintaining the status of play of the game. The system provides for turns at play of two players representing opposing teams with a predetermined number of game periods available for total game play.

While there has been shown and described a preferred embodiment it is to be understood that various other adaptations and modifications may be made within the spirit and scope of the invention.

What is claimed is:

1. In an electronic game for simulating baseball or the like having a defined playing field with a defined path of travel of an object such as a ball to a defined opposing player location for contact therewith, the player then traveling a defined player advance path to the point of origin, the combination comprising;

a playing field;

a plurality of groups of illuminatable segments on said playing field, each segment within a group having a predetermined location and each group of segments having a predetermined orientation relative to each other;

control means internal to said game for selectively illuminating one or more segments of one or more of said groups;

first manually operable means providing a first input signal to said control means for sequentially energizing the segments of one of said groups to simulate the path of travel of an object;

second manually operable means for providing a second input signal to said control means;

means responsive to a timed relation between said second input signal and the illumination of one of a selected number of segments of said one group for providing an intermediate signal; and third manually operable means operable only in response to said intermediate signal for selectively and sequentially energizing at least one other group of said segments for simulating player advance in response thereto.

2. The combination according to claim 1 further including means within said control means for varying the rate of sequential energization of said one group of segments.

3. The combination according to claim 1 wherein said control means further includes means for altering the path of sequential energization of the segments of said one group.

4. The combination according to claim 1 wherein said control means further includes means for varying the rate of sequential energization of the segments of said at least one other group of segments.

5. The combination according to claim 1 wherein said game further includes probability determining means for determining the time duration of enablement of sequential energization of the segments of said at least one other group of segments whereby to limit the player advance distance along the player advance path.

6. The combination according to claim 1 wherein said means responsive to the timed relation includes counter means and said third manually operable means is operable for selectively and sequentially energizing said at least one other group of said segments for the time duration of said counter means.

7. The combination according to claim 1 further including probability determining means responsive to the timed relation between said second input signal and the illumination of one of a selected number of segments of said one group for selectively energizing one of another of the groups of said segments.

8. The combination according to claim 7 wherein the illumination of said one of said another group of segments provides a visual indication of the timed relation between said second input signal and the illumination of one of the selected number of segments of said one group.

9. The combination according to claim 8 further including means for varying the rate of sequential energization of the segments of said at least one other group of segments.

10. In a simulated electronic baseball game, the combination comprising:

a playing field;

a first group of illuminatable segments on said playing field simulating the base locations of a baseball diamond;

a second group of illuminatable segments simulating the path of a pitch in a baseball game from the pitcher's mound to home plate;

a third group of illuminatable segments simulating outfield positions on a baseball diamond;

a fourth group of illuminatable segments at positions generally intermediate said base locations;

processor means;

first manually operable means providing an input to said processor means for sequentially energizing the segments of said second group;

second manually operable means for providing an input signal to said processor means;

means within said processor means for determining the timed relation of occurrence between the input of said second manually operable means and the energization of a predetermined one of a few of the second group of segments;

means responsive to such occurrence for selectively energizing at least one of said third group of segments; and third manually operable means operable in response to energization of one of said third group of segments for sequentially illuminating the segments of said first and fourth groups to simulate a player running the base paths.

11. The combination according to claim 10 further including timing means operable in response to such occurrence for limiting the number of segments of said first and fourth group which may be energized in response to said third manually operable means.

12. The combination according to claim 11 further including means within said processor means operable in response to the timing out of said timing means for comparison with the energization of a particular segment of said first and fourth group and for automatically affecting the progress of the game in accordance with a predetermined algorithm.

13. The combination according to claim 12 wherein the means responsive to the timing out of said timing means and said predetermined algorithm affect the progress of the game if one of said fourth group of segments is illuminated upon the timing out of said timing means.

14. The combination according to claim 13 wherein said fourth group includes two illuminatable segments intermediate adjacent ones of said first group of segments and said predetermined algorithm affects the illumination of one of said first group of segments in the event one of said fourth group of segments is illuminated upon the timing out of said timing means.

15. In an electronic game for simulating baseball, the combination comprising:

a playing field;

a plurality of groups of illuminatable segments on said playing field, each segment within a group having a predetermined location and each group of segments having a predetermined orientation relative to each other;

control means internal to the game for selectively illuminating one or more segments of one or more of said groups;

first manually operable means providing an input to said control means for sequentially energizing the segments of one of said groups to simulate the path of travel of a ball;

second manually operable means for providing a second input signal to said control means;

means for comparing the occurrence of said second input signal in timed relation with the illumination of one of the segments of said one group;

means responsive to said means for comparing for automatically affecting the progress of the game in accordance with a predetermined algorithm in response to determination of the timing of said second input signal and the illumination of a selected one of the segments of said one group, including means responsive to concurrence of timing of said second input signal and the illumination of a selected one of the segments of said one group for selectively energizing at least one of another group of segments; and third manually operable means operable in response to energization of one of said other group of segments for enabling sequential illumination of the segments of still another of the groups of said segments for simulating base running.

16. The combination according to claim 15 wherein said means for automatically affecting the progress of the game includes first probability determining means operable in response to the timed relation between said second input signal and the illumination of a predetermined one of a few of the segments of said one group for generating one of a first hit signal and a second miss signal.

17. The combination according to claim 16 wherein said at least one of another group of illuminatable signals is so positioned on said playing field to define a base path and said means for automatically affecting the progress of the game includes second probability determining means responsive to said first hit signal for determining the number of segments which may be sequentially energized.

18. In an electronic game for simulating baseball, the combination comprising:

a playing field;

a plurality of groups of illuminatable segments on said playing field, each segment within a group having a predetermined location and each group of segments having a predetermined orientation relative to each other, at least one of said groups of illuminatable signals being so positioned on said playing field to define a base path, an another of said groups being so positioned on said playing field for simulating the path of travel of a ball;

control means internal to the game for selectively illuminating one or more segments of one or more of said groups;

first manually operable means providing an input to said control means for sequentially energizing the segments of said another group to simulate the path of travel of the ball;

second manually operable means for providing a second input signal to said control means;

means for comparing the occurrence of said second input signal in timed relation with the illumination of one of the segments of said one group; and means responsive to said means for comparing for automatically affecting the progress of the game in accordance with a predetermined algorithm including first and second probability determining means, said first probability determining means being operable in response to the timed relation between said second input signal and the illumination of a predetermined one of a few of the segments of said another group for generating one of a first hit signal and a second miss signal, with said second probability determining means being responsive to said first hit signal for determining the number of segments of said one group which may be sequentially energized.

19. The combination according to claim 18 further including third manually operable means for enabling the sequential energization of said segments of the base path a number of segments not to exceed the number of segments determined by said second probability determining means.

20. The combination according to claim 19 wherein said second probability determining means selectively actuates timer means in response to indication of a number of base path segments less than all of said segments and said third manually operable means selectively energizes said segments only within the time of said timer means.

21. The combination according to claim 20 wherein said control means is operable in response to said probability determining means determining a number of segments equal to all of said base path segments for selectively illuminating at least one segment of at least two groups of segments whereby to simulate a home run.

22. The combination according to claim 21 further including means for determining a number of player game events.

23. The combination according to claim 22, wherein said combination further includes means operable in response to a number of player game events for indicating second player operation of the game.

* * * * *